US006556232B2

(12) United States Patent
Ohba

(10) Patent No.: US 6,556,232 B2
(45) Date of Patent: Apr. 29, 2003

(54) BASE STRUCTURE, PROCESSING DEVICE, AND IMAGE FORMING DEVICE

(75) Inventor: Masahiro Ohba, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/820,976

(22) Filed: Mar. 30, 2001

(65) Prior Publication Data

US 2001/0026313 A1 Oct. 4, 2001

(30) Foreign Application Priority Data

Mar. 30, 2000 (JP) ..... 2000-095684

(51) Int. Cl.[7] ..... B41J 27/00
(52) U.S. Cl. ..... 347/242; 347/257
(58) Field of Search ..... 347/242, 245, 347/252, 263, 257; 400/82; 310/323.02

(56) References Cited

U.S. PATENT DOCUMENTS 4,576,490 A * 3/1986 Isobe ..... 400/82
4,782,262 A * 11/1988 Kiyo-Oka ..... 310/323.02

FOREIGN PATENT DOCUMENTS

JP 6-150356 * 5/1984 ..... G11B/7/12

* cited by examiner

*Primary Examiner*—Hai Pham
(74) *Attorney, Agent, or Firm*—Sughrue Mion, PLLC

(57) ABSTRACT

A platform for precisely moving a stage and holding the stage at a position to which the stage has been moved, using an eccentric cam. The platform uses plate springs to support the stage at which an exposure head is formed. An outer circumferential portion and a central axis portion of the eccentric cam rotate relative to one another, and the plate springs urge legs of the stage toward the outer circumference. As a stepping motor drives the eccentric cam to rotate, the legs are urged to abut the outer circumference. Due to the rotation of the eccentric cam, the stage is moved in the direction the plate springs and the rotating drum approach/separate from one another, and held at a position where the eccentric cam has stopped.

20 Claims, 5 Drawing Sheets

BASE STRUCTURE, PROCESSING DEVICE, AND IMAGE FORMING DEVICE

BACKGROUND OF THE INVENTION

1. Field of the Invention

The present invention relates to a base structure, a processing device, and an image forming device.

2. Description of the Related Art

In an image exposure device for exposing a light-sensitive material such as a light-sensitive planographic printing plate used for printing or the like (which is referred to as a "printing plate" hereinafter), a semiconductor laser, an LED (light emitting diode) or the like is used as a light source, and a light beam emitted from this light source scans and exposes a printing plate. At this time, the light beam is modulated on the basis of image data, and an image is formed on the printing plate.

A light source for exposure provided at such an image exposure device is mounted on a substantially plate-shaped stage integrated with an optical system to thereby form an exposure head. Thus, a light beam emitted from the light source is irradiated from the exposure head onto the printing plate, whereby the printing plate is exposed.

If a distance between the exposure head and the printing plate is not adjusted appropriately, focal displacement may occur in which a spot diameter of the light beam spreads. In order to prevent such focal displacement, sometimes a moving mechanism is provided at the stage at which the light source and the like are mounted to enable the exposure head to approach and move away from the recording medium. Accordingly, the printing plate and the exposure head can be held at an appropriate distance and focused.

An example of the moving mechanism which is applied to such a focusing includes: a moving mechanism in which a fine movement of the stage by about 1 $\mu$m, for example, can be performed by using an eccentric cam. In the moving mechanism using such an eccentric cam, a sliding member, a bearing, and the like are disposed at legs which protrude from the stage so as to face the eccentric cam. While the eccentric cam rotates eccentrically, the circumferential surface of the eccentric cam and the sliding member or the bearing abut against one another and press the legs, and the stage thereby moves.

However, when the sliding member is disposed at the eccentric cam, as the eccentric cam rotates, the sliding member is slid with the rotation of the eccentric cam so that abrasion or deformation may cause therebetween, thus leading to an error in a moving amount of the stage. Further, when the bearing is disposed so as to face the eccentric cam, as the eccentric cam rotates, a position at which the eccentric cam contacts the bearing changes, thus leading to a change in the moving amount of the stage.

The most important problem with the moving mechanism using the eccentric cam is that, since another fixing means is provided independently of the moving mechanism in order to fix the stage which has stopped moving, it becomes extremely difficult to move, position, and fix the stage by using the eccentric cam while maintaining the position to which the stage has moved. When the stage thus positioned is fixed by the fixing means, there arises a problem that the stage may be displaced slightly from a desired position at which the stage should be fixed.

SUMMARY OF THE INVENTION

In view of the aforementioned facts, it is an object of the present invention to provide a base structure, a processing device, and an image forming device capable of successfully overcoming and improving such drawbacks as described above.

In order to solve the aforementioned problems, a first aspect of the present invention is a base structure, the base structure comprising: (A) two bases between which a linear relative movement is enabled; (B) a cam element provided at one of said two bases and driven to rotate; and (C) an abutting portion provided at the other of said two bases and on which said cam element abuts, (D) wherein said cam element includes: a central axis portion rotatable around a rotational axis as a center; a rolling element movably provided at said central axis portion; and a cylindrical outer ring rotatably provided with respect to said central axis portion through said rolling element, the rotational axes of said outer ring and said central axis portion being substantially parallel to one another and spaced apart from one another at a predetermined distance.

A second aspect of the present invention is a processing device for applying a predetermined processing to an object, the processing device comprising: (I) a processing element for applying a predetermined processing to an object; and (II) a base device capable of changing a position of said processing element with respect to said object, the base device including: (a) a first base and a second base between which a linear relative movement is enabled; (b) a cam element provided at said first base and driven to rotate; and (c) an abutting portion provided at said second base and on which said cam element abuts, wherein said cam element includes: a central axis portion rotatable around a rotational axis as a center; a rolling element movably provided at said central axis portion; and a cylindrical outer ring rotatably provided with respect to said central axis portion through said rolling element, the rotational axes of said outer ring and said central axis portion being substantially parallel to one another and spaced apart from one another at a predetermined distance.

A third aspect of the present invention is an image forming device for forming an image on a printing plate, the image forming device comprising: (I) a rotatably mounted drum having a periphery around which a printing plate can be releasably wound and fixed; (II) a mount for rotatably supporting said drum; (III) a recording head for recording an image on a printing plate; (IV) a base device for changing a position of said recording head with respect to said rotating drum, said base device including: (a) a first base and a second base, one of the bases being fixed at said mount side and the other being fixed at said recording head side, between which a linear relative movement is enabled; (b) a cam element provided at said first base and driven to rotate; and (c) an abutting portion provided at said second base and on which said cam element abuts; (d) wherein said cam element includes: a central axis portion rotatable around a rotational axis as a center; a rolling element movably provided at said central axis portion; and a cylindrical outer ring rotatably provided with respect to said central axis portion through said rolling element; the rotational axes of said outer ring and said central axis portion being substantially parallel to one another and spaced apart from one another at a predetermined distance.

DESCRIPTION OF THE PREFERRED EMBODIMENTS

Figure 1:
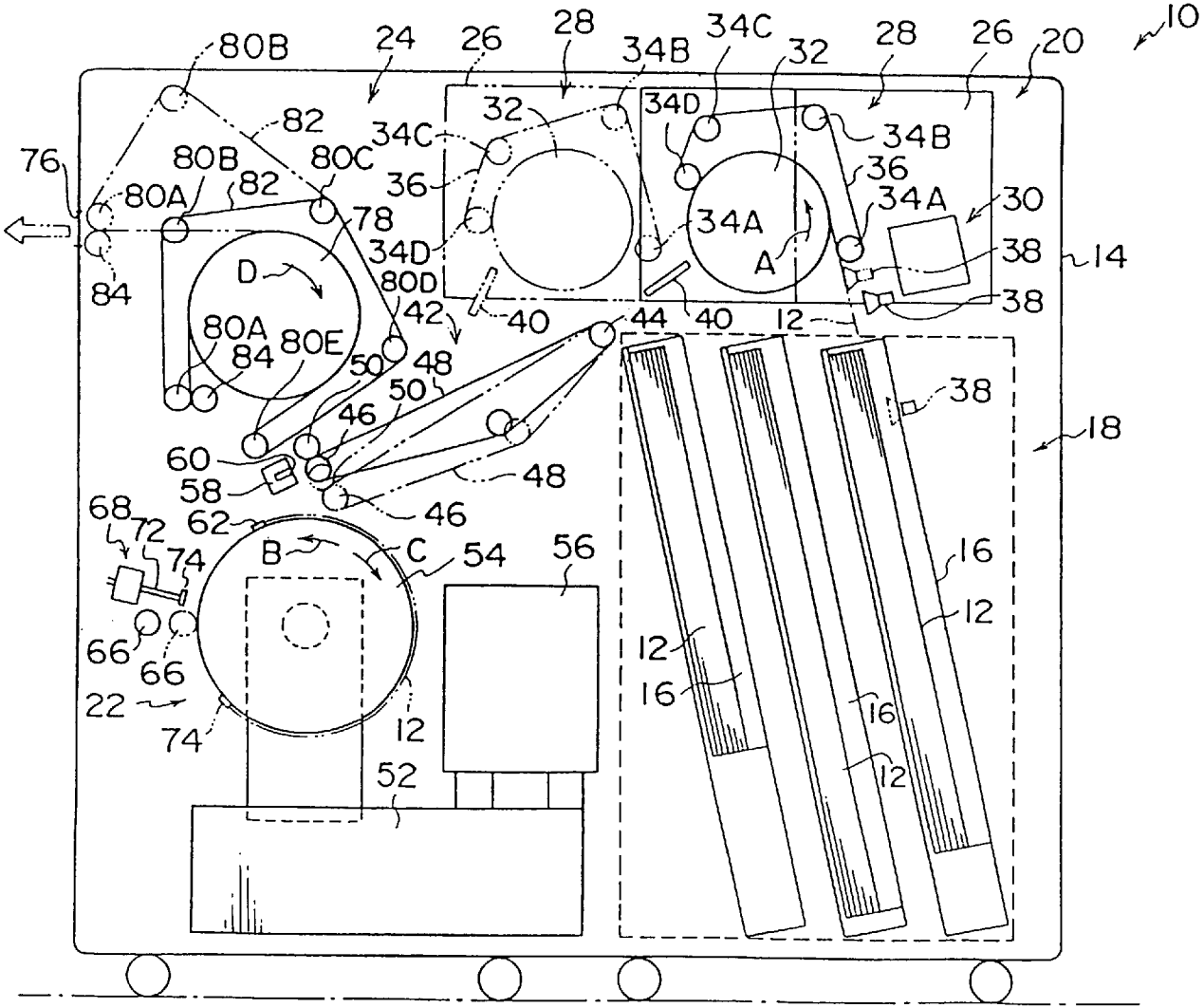
FIG. 1 is a schematic structural view of an image exposure device to which an embodiment of the present invention is applied.

With reference to drawings, an embodiment of the present invention will be explained hereinafter. FIG. 1 shows a schematic structure of an image exposure device 10 to which the embodiment of the present invention is applied. Using a light-sensitive planographic plate (hereinafter referred to as a "printing plate 12"), in which a light-sensitive layer is formed on a thin (e.g., having a thickness of about 0.3 mm), rectangular plate support formed of, for example, aluminum, the image exposure device 10 irradiates onto the printing plate 12 a light beam modified on the basis of image data, whereby the printing plate 12 is scanned and exposed. The printing plate 12 for which an image exposure has been completed by the image exposure device 10 is subjected to development processing or the like by an unillustrated automatic processor or the like.

As shown in FIG. 1, at the image exposure device 10, there are provided a cassette loading section 18, a plate feeding and conveyance section 20, a recording section 22, a discharge buffer section 24, and the like inside a machine casing 14. The cassette loading section 18 is disposed at the right lower side of the machine casing 14 in FIG. 1. A plurality of cassettes 16, that each accommodate a plurality of printing plates 12, is loaded at a predetermined angle in a state in which the cassettes 16 are slanted in the cassette loading section 18.

It is possible to process in the image exposure device 10 numerous-sized printing plates 12 having different vertical and horizontal dimensions. Printing plates 12 of whatever size are accommodated in the cassettes 16 such that the light-sensitive layers of the printing plates 12 face upward and an end thereof is positioned to correspond to a predetermined position. Further, the cassettes 16 which accommodate therein different sizes of the printing plates 12 are loaded at the cassette loading section 18 at predetermined intervals such that an end of the printing plates 12 accommodated in each cassette 16 reaches a substantially constant height.

The plate feeding and conveyance section 20 is disposed above the cassette mounting portion 18. The recording section 22 is disposed at a lower, central area within the image exposure device 10, adjacent to the cassette loading section 18. A pair of side plates 26 (one of them is shown in FIG. 1) is provided at the plate feeding and conveyance section 20, and an reversal unit 28 and a sheet unit 30 are mounted to each of the side plates 26.

The reversal unit 28 is provided with an reversal roller 32 having an outside diameter of a predetermined dimension. A plurality of small rollers 34 (for example, four small rollers 34A, 34B, 34C and 34D in the present embodiment) are provided around the reversal roller 32. The small rollers 34A to 34D are disposed so a to straddle the inverting roller 32 from the cassette loading section 18 to the recording section 22, and an endless conveyor belt 36 is entrained around these small rollers 34A to 34D. Accordingly, the conveyor belt 36 is entrained over the reverse roller 32 so that the conveyor belt 36 stretches to roughly half the circumference of the reverse roller 32 between the small roller 34A and the small roller 34D.

The sheet unit 30 is provided with a plurality of suction cups 38 which suck an upper end of the printing plate 12 in the cassettes 16. The sheet unit 30 lowers the suction cups 38 so as to face the upper end of the printing plates 12 in the cassette 16 loaded at the cassette loading section 18, whereby the printing plate 12 is sucked by the suction cups 38. The sheet unit 30 then substantially raises the suction cups 38 which have adsorbed the printing plate 12 so as to pull the leading edge of the printing plate 12 from the cassette 16, and the leading edge of the printing plate 12 is then inserted between the reverse roller 32 and the conveyor belt 36. In FIG. 1, a position at which the suction cups 38 move is schematically illustrated by a double-dashed line.

At the reversal unit 28, the reversal roller 32 and the conveyor belt 36 are rotated in a direction in which the printing plate 12 is pulled out from the cassette 16 (in the direction of arrow A in FIG. 1). When the leading edge of the printing plate 12 is nipped between the reversal roller 32 and the conveyor belt 36, the printing plate 12 is wound around the circumferential surface of the reversal roller 32 while being pulled out from the cassette 16. Accordingly, the printing plate 12 is conveyed and inverted while being curved, and a direction in which the printing plate 12 is conveyed is thereby deflected. The radius of the reverse roller 32 is of a dimension (e.g., 100 mm or more) such that kinks or bends are not generated in the printing plate 12 at the time the printing plates 12 have been curved.

As shown by the solid line and the double-dashed line in FIG. 1, the side plates 26 move horizontally in accordance with the position of the cassette 16 from which the printing plate 12 is to be pulled out. Accordingly, the sheet unit 30 can move integrally with the reversal unit 28 so that the suction cups 38 face the printing plate 12 in the desired cassette 16.

At the side plates 26, a guide 40 is provided below the small roller 34D. The printing plate 12 which has been inverted by the reversal roller 32 is passed between the reversal roller 32 at the small roller 34D side and the conveyor belt 36, and fed to this guide 40.

A conveyer 42 is disposed above the recording section 22, and the printing plate 12 which has been fed out from the reversal unit 28 is guided to the conveyer 42 by the guide 40. Further, the guide 40 swings in accordance with the movement of the side plate 26 such that the direction in which the printing plate 12 is guided is always directed to the conveyer 42. Moreover, the small roller 34D near the recording section 22 moves in accompaniment with the movement of the side plate 26 to alter the direction in which the printing plate 12 is fed out from the reversal unit 28. When the small roller 34D moves, the small roller 34C moves to provide a substantially fixed tension to the conveyor belt 36, and the printing plate 12 fed out from the reversal unit 28 is thereby gently curved by the guide 40.

At the conveyor 42, a conveyor belt 48 is entrained between a roller 44 adjacent to an area beneath lower portion of the plate feeding and conveyance section 20 and a roller 46 adjacent to an area above the recording section 22. The conveyor 42 is slanted such that the roller 46 is disposed lower than the roller 44.

Figure 2:
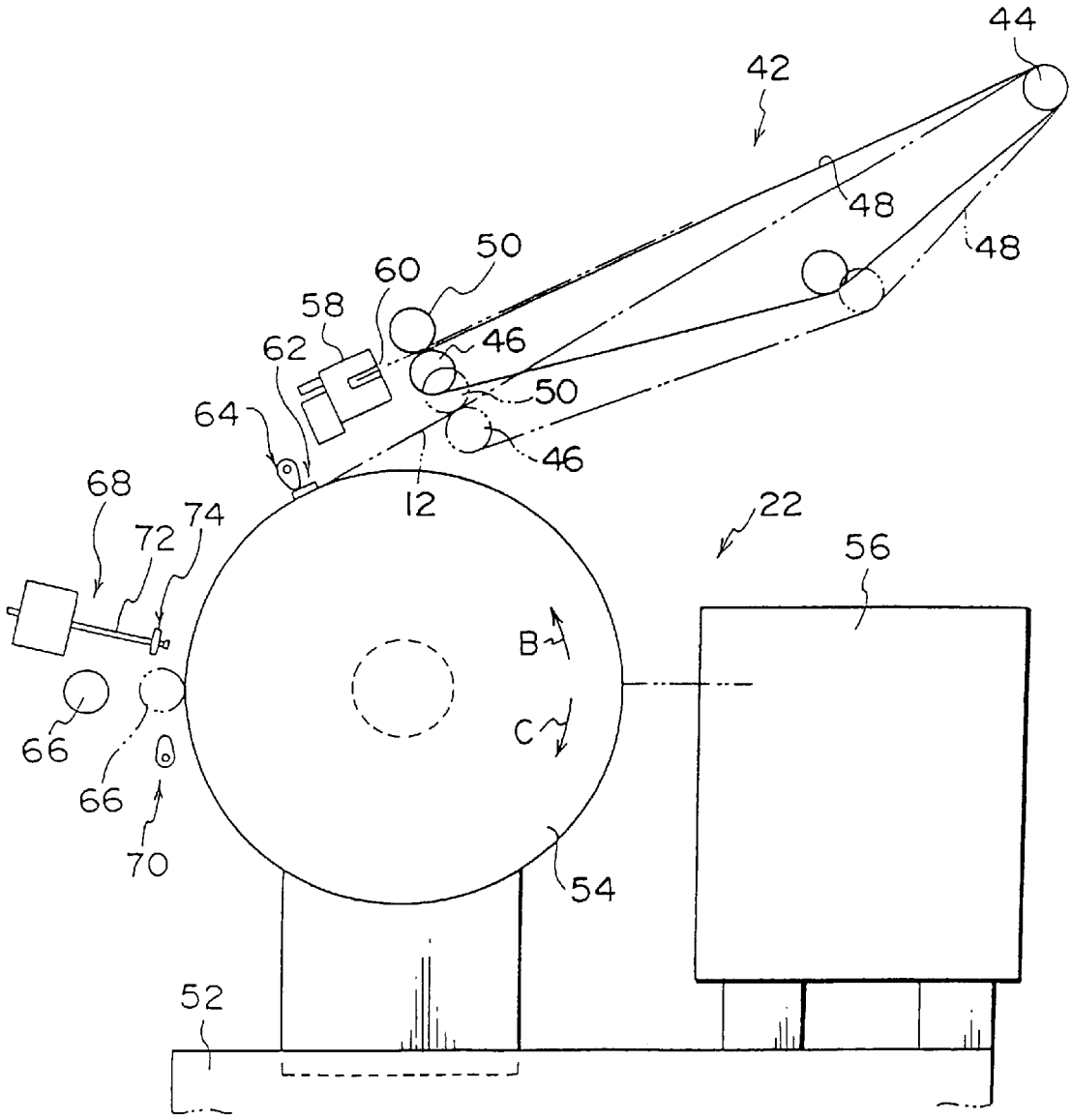
FIG. 2 is a schematic structural view illustrating a recording section of the image exposure device.

As shown in FIGS. 1 and 2, a roller 50 is disposed at the conveyor 42 so as to face the roller 46. The printing plate 12 which has been fed to the conveyor 42 is conveyed along the conveyor belt 48, nipped by the roller 46 and the roller 50, and then fed out from the conveyor 42.

At the recording section 22, a rotating drum 54 is mounted on a mount 52, and a recording head portion 56 is disposed so as to face the rotating drum 54. Further, at the image exposure device 10, a puncher 58 is disposed above the recording section 22 (the rotating drum 54) so as to oppose the rollers 46 and 50 of the conveyor 42.

As shown in FIG. 2, an opening 60 is formed at the puncher 58. The printing plate 12 is held at the conveyor 42 such that the printing plate 12 is nipped by the rollers 46 and 50 and the leading edge of the printing plate 12 is inserted into the opening 60 of the puncher 58. As a position-determiner, the puncher 50 forms, for example, a notch at a predetermined position of the leading edge of the printing plate 12 which has been inserted into the opening 60. The printing plate 12 is positioned, for example, on the conveyor 42 and then fed to the puncher 58, whereby the notch for positioning is formed at a predetermined position of the leading edge of the printing plate 12.

When the notch has been formed in the printing plate 12, the conveyor 42 drives the conveyor belt 48 inversely, and then pulls the leading edge of the printing plate 12 out from the opening 60 of the puncher 58. The conveyor 42 is swingable by an unillustrated swinging means with the roller 44 side as an axis. When the printing plate 12 has been pulled out from the puncher 58, the conveyer swings (shown by a double-dashed line in FIGS. 1 and 2) and then feeds the printing plate 12 to the recording section 22 after the leading edge of the printing plate 12 has been directed to a predetermined position at the outer circumferential surface of the rotating drum 54.

Due to a driving force of an unilllustrated driving means, the rotating drum 54 provided at the recording section 22 is driven to rotate at a predetermined rotational speed in the direction in which the printing plate 12 is mounted and exposed (the direction of arrow B in FIGS. 1 and 2) or in the direction in which the printing plate 12 is removed from the rotating drum 12 (the direction of arrow C in FIGS. 1 and 2) which opposes the direction in which the printing plate 12 is mounted and exposed.

As shown in FIG. 2, a leading edge chuck 62 is mounted at a predetermined position of the outer circumferential surface of the rotating drum 54. At the recording section 22, when the printing plate 12 is mounted to the rotating drum 54, the rotating drum 54 is stopped at a position at which the leading edge chuck 62 opposes the leading edge of the printing plate 12 fed along the conveyor 42 (i.e., a position at which the printing plate is mounted to the rotating drum 54).

At the recording section 22, a setting cam 64 is provided which opposes the leading edge chuck 62 at a position at which the printing plate 12 is attached to the rotating drum 54. Due to a rotation of the setting cam 64, the leading edge chuck 62 at an end thereof is pressed, whereby the printing plate 12 becomes insertable between the leading edge chuck 62 and the circumferential surface of the rotating drum 54. At the recording section 22, in a state in which the leading edge of the printing plate 12 has been inserted between the leading edge chuck 62 and the rotating drum 54, the setting cam 64 is returned to its original position so that the end of the leading edge chuck 62 is no longer pressed, whereby the leading edge of the printing plate 12 is nipped and held between the leading edge chuck 62 and the circumferential surface of the rotating drum 54.

At the image exposure device 10, an unillustrated positioning pin, which projects from the circumferential surface of the rotating drum 54 at a predetermined position thereof, enters the notch which has been formed at the leading edge of the printing plate 12 so that the printing plate 12 is positioned with respect to the rotating drum 54.

At the circumference of the rotating drum 54, a squeeze roller 66 is disposed in a mounting/exposure direction (i.e., the direction of arrow B), further downstream than the position at which the printing plate 12 is mounted. The squeeze roller 66 is moved toward the rotating drum 54 to press the printing plate 12 wound around the rotating drum 54 toward the rotating drum 54, whereby the printing plate 12 contacts the circumferential surface of the rotating drum 54.

At the recording section 22, a trailing edge chuck detaching unit 68 is provided in a mounting/exposure direction of the rotating drum 54, further upstream than the squeeze roller 66. A removal cam 70 is disposed at the downstream side of the rotating drum 54 in the direction of the arrow B. At the trailing edge chuck detaching unit 68, a trailing edge chuck 74 is disposed detachably at the tip end of a shaft 72 that projects toward the rotating drum 54.

Further, at the recording section 22, when the trailing edge of the printing plate 12 which has been wound around the rotating drum 54 reaches a position at which the trailing edge of the printing plate 12 opposes the trailing edge chuck detaching unit 68, the rotation of the rotating drum 54 temporarily stops and the trailing edge chuck 74 is attached at a predetermined position of the rotating drum 54. Thus, the trailing edge of the printing plate 12 which has been wound around the rotating drum 54 is nipped between the trailing edge chuck 74 and the rotating drum 54, and fixed thereto.

At the outer circumferential surface of the rotating drum 54, there are formed unillustrated adsorbing grooves for adsorbing and holding the printing plate 12 which has been wound around the rotating drum 54. At the recording section 22, the leading edge and the trailing edge of the printing plate 12 in the transporting direction thereof are respectively fixed by the leading edge chuck 62 and the trailing edge chuck 74, and are adsorbed by a negative pressure supplied to the suction grooves to thereby adhere the printing plate 12 onto the circumferential surface of the rotating drum 54.

At the recording section 22, when the printing plate 12 is positioned at the rotating drum 54 and wound therearound, the squeeze roller 66 is made to separate from the rotating drum 54. While the rotating drum 54 is made to rotate at a predetermined rotational speed, synchronous with the rotation of the rotating drum 54, a light beam which has been transmitted from the recording head portion 56 and modulated on the basis of image data is irradiated onto the printing plate 12. Thus, the printing plate 12 is scanned and exposed on the basis of the image data, and an image is formed at a predetermined position of the printing plate 12.

At the recording section 22, when the scanning and exposing of the printing plate 12 have been completed, the rotating drum 54 stops at a position where the trailing edge chuck 74 is removed from the rotating drum 54. T he trailing edge chuck 74 is removed from the rotating drum 54 in a state in which the printing plate 12 is nipped by the squeeze roller 66 between the rotating drum 54 and the squeeze roller 66 so that the nipping of the trailing edge of the printing plate 12 is cancelled.

At the recording section 22, when the trailing edge chuck 74 is removed from the rotating drum 54, the rotating drum 54 rotates in a direction in which the printing plate 12 is taken off. Accordingly, the printing plate 12 is fed from between the squeeze roller 66 and the rotating drum 54.

As shown in FIG. 1, the discharge buffer section 24 is disposed above the recording section 22. Due to a rotation of the rotating drum 54 in the direction in which the printing plate 12 is taken out, the printing plate 12 is fed from the trailing edge side thereof toward the discharge buffer section 24. Further, at the recording section 22, when the rotating drum 54 has rotated in the direction in which the printing plate 12 is taken out, so that the leading edge chuck 62 has reached the position at which the printing plate 12 is taken out and at which the leading edge chuck 62 opposes the removal cam 70, the rotating drum 54 is stopped, and the removal cam 70 rotates at this position. Accordingly, the nipping of the leading edge of the printing plate 12 between the leading edge chuck 62 and the rotating drum 54 is cancelled so that the printing plate 12 is removed from the rotating drum 54.

At the discharge buffer section 22, a discharging roller 78 is provided at an inner side of a discharging outlet 76 formed in the machine casing 14. A plurality of small rollers (for example, five small rollers 80A, 80B, 80C, 80D, and 80E) is disposed around the periphery of the discharging roller 78. The conveyor belt 82 is thus wound between the small rollers 80A to 80E around the ejection roller 78 in a range of between about ½ to about ¾ the circumference of the ejection roller 78.

The small roller 80A is disposed so as to protrude toward the squeeze roller 66 side of the recording section 22, and a roller 84 is disposed so as to face the small roller 80A. The printing plate 12 fed from the recording section 22 is guided to and nipped between the small roller 80A and the roller 84.

At the discharge buffer section 24, the discharging roller 78 is driven to rotate in the direction in which the printing plate 12 is pulled out (in the direction of arrow D). Thus, the printing plate 12 which is nipped between the small roller 80A and the roller 84 is pulled out from the recording section 22, and at the same time, the printing plate 12 is guided between the discharging roller 78 and the conveyor belt 82. Then, the printing plate 12 is nipped between the discharging roller 78 and the conveyor belt 82, and is wound around the discharging roller 78. At this time, at the discharge buffer section 24, the leading edge of the printing plate 12 (i.e., the trailing edge side at the time the printing plate 12 is fed out from the recording section 22) is nipped between the small roller 80A and the roller 84 so that the printing plate 12 which has been wound around the discharging roller 78 is temporarily held.

As shown by a double-dashed line in FIG. 1, at the discharge buffer section 24, the small roller 80A and the roller 84 move to a position at which the small roller 80A and the roller 84 face the discharging outlet 76. At this time, the small roller 80A and the roller 84 are moved integrally with each other so that the leading edge of the printing plate 12 is directed to the discharging outlet 76. Further, the small roller 80B above the small roller 80A moves in accordance with the movement of the small roller 80A so that a constant tension is applied to the conveyor belt 82.

At the discharge buffer section 24, when the leading edge of the printing plate 12 is directed to the discharging outlet 76, the discharging roller 78 is rotated in the direction that the printing plate 12 is discharged (i.e., the opposite direction of arrow D) at a rotational speed that corresponds to the speed at which the printing paper 12 is conveyed at processing devices, such as an automatic processor and the like (not illustrated), provided adjacent to the discharging outlet 76. Accordingly, the printing plate 12 is fed out from the discharging outlet 76.

Image data to which the printing plate 12 is to be exposed is inputted to the image exposure device 10 thus formed. When the size and the number of the printing plates 12 on which an image exposure is carried out are determined, and when the start of the image exposure is instructed, image exposing processing of the printing plate 12 begins. The image exposure device 10 may be a kind in which an operation panel is provided at the image exposure apparatus 10 and instructions are given by operation of a switch at the operation panel, and it may be a kind in which initiation of processing by the image exposure device 10 is ordered by a signal from an image processing device that outputs image data to the image exposure device 10.

When the image exposure device 10 has been instructed to start the processing, a specified size of the printing plate 12 is taken out from one of the cassettes 16 and placed on the conveyor 42, and thereby fed to the recording section 22. At this time, a notch for positioning is formed in the printing plate 12 by a puncher 58.

At the recording section 22, when the leading edge of the printing plate 12 is held at the rotating drum 54 by the leading edge chuck 62, the printing plate 12 is wound around the rotating drum 54 while being squeezed by the squeeze roller 66, and the trailing edge of the printing plate 12 is held at the rotating drum 54 by the trailing edge chuck 74.

Thereafter, at the recording section 22, a light beam on the basis of image data is irradiated from the recording head portion 56 onto the printing plate 12 while the rotating drum 54 is rotating at high speed, and the printing plate 12 is scanned and exposed. Namely, a predetermined region of the printing plate 12 is scanned and exposed so that an image is formed on the printing plate 12.

When an image is formed on the printing plate 12, the printing plate 12 is fed to the discharge buffer section 24 from the trailing edge side of the printing plate 12 while being removed from the rotating drum 54. At the discharge buffer section 24, once this printing plate 12 is wound around the discharging roller 78, the discharging roller 78 is inversely driven to direct the leading edge of the printing plate 12 to the discharging outlet 76. Thus, the printing plate 12 is fed from the discharging outlet 76 at a predetermined conveyance speed, and then discharged from the image exposure device 10.

Figure 3:
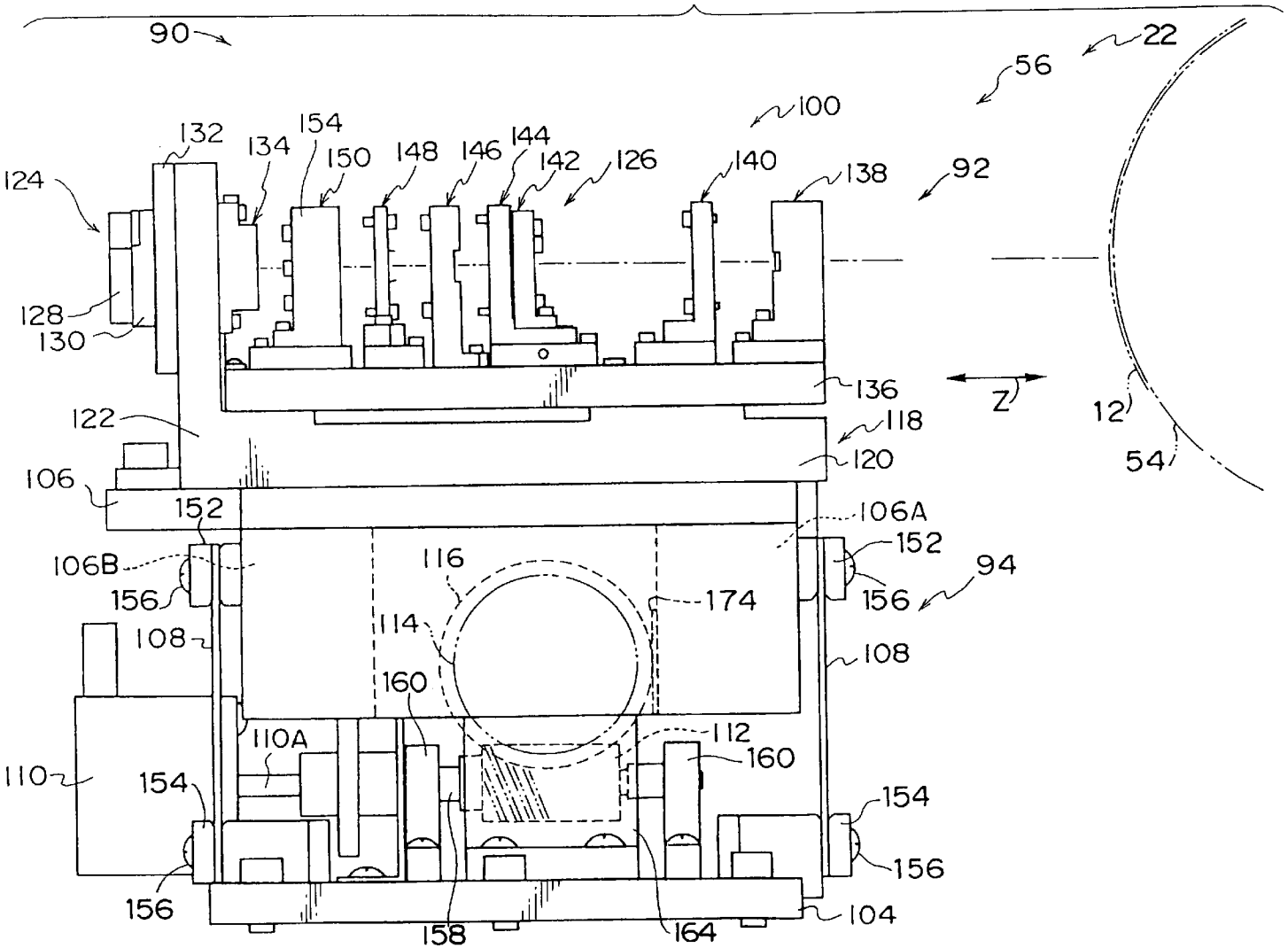
FIG. 3 is a schematic structural view illustrating a main portion of a scanning and exposing device provided at the recording section.

As shown in FIG. 3, at the recording section 22, a scanning and exposing device 90 is formed by the rotating drum 54 and the recording head portion 56. The recording head portion 56 has a recording (exposing) head 92, and a light beam emitted from the recording head 92 is irradiated onto the printing plate 12 which has been wound around the rotating drum 54.

The recording head 92 is formed by a stage 106, and a light source unit 100 which is mounted to the stage 106. The light source unit 100 is provided with a base portion 120 and a base 118. The base portion 120 faces the stage 106. The base 118 has a vertical wall 122 vertically disposed at an end thereof to thereby form a substantial L-shape with respect to the base 118. At the light source unit 100, the base portion 120 is mounted on the stage 106 at a predetermined position thereof, and fixed thereat.

At the light source unit 100, a light source assembly 124 is mounted to the vertical wall 122, while an optical system assembly 126 is mounted to the base portion 120.

The light source assembly 124 is provided with light source holders 128 and 130, and through a base plate 132, is mounted on a surface of the vertical wall 122 at the side opposite to the rotating drum 54 (i.e., at the left side in FIG.

3). At this light source assembly 124, a laser diode, which is a semiconductor light-emitting element, is provided between the light source holders 128 and 130. Further, a collimator lens is mounted to the light source holder 130 (neither the laser diode nor the collimator lens is shown).

By mounting the light source assembly 124, in which the laser diode and the collimator lens are assembled with a distance therebetween adjusted beforehand, to the vertical wall 122, the laser and the collimator lens are mounted at predetermined positions of the light source unit 100. Further, a parallel plate holder 134 in which a parallel plate (not shown) is provided on the surface of the parallel plate holder 134 at a rotating drum 54 side is mounted to the vertical wall 122. Through this parallel plate, a light beam which is emitted from the light source assembly 124 is transmitted to an optical system assembly 126.

To the optical system assembly 126 is mounted a converging lens holder 138 in which a converging lens is assembled at a longitudinal direction end side of an elongated fixing platform 136. Further, on the fixing platform 136, in a sequential order from the side of the converging lens holder 138, there are disposed: a cylindrical lens holder 140 to which a convex cylindrical lens is mounted; a uniaxial crystalline holder 142 to which a uniaxial crystalline is mounted; a cylindrical lens holder 144 to which a concave cylindrical lens is mounted; a parallel plate holder 146 to which a parallel plate is mounted; an aperture holder 148 to which an aperture is mounted; and a holder 150 to which a convex cylindrical lens and a ½ wavelength plate are mounted. Moreover, the uniaxial crystalline holder 142 is mounted to the cylindrical lens holder 144.

At the optical system assembly 126, the converging lens holder 138 is located at the rotating drum 54 side (at the opposite side of the vertical wall 122). The fixing platform 136 is mounted to the base portion 120 of the base 118. Accordingly, the light beam emitted from the light source assembly 124 is transmitted through the parallel plate, the ½ wavelength plate, the cylindrical lens, the aperture, the parallel plate, the cylindrical lens, the uniaxial crystalline, the cylindrical lens, and the converging lens, and then irradiated onto the printing plate 12.

Beneath the stage 106, there is provided a platform 104. This platform 104 is mounted to the mount 52 (not shown in FIG. 3) through an unillustrated sub-scanning mechanism.

Synchronous with a rotation of the rotating drum 54 around which the printing plate 12 has been wound, the sub-scanning mechanism moves the exposure head 92 and the platform 104 in a sub-scanning direction which is an axial direction of the rotating drum 54. At this time, synchronous with the rotation of the rotating drum 54 and with the movement of the exposure head 92 in the sub-scanning direction thereof, on the basis of image data, a light beam from the exposure head 92 is irradiated onto the printing plate 12 to scan and expose the same.

As the scanning and exposing device 90, there can be used a scanning and exposing device in which the exposure head 92 which is formed by the light source unit 100 is moved in the sub-scanning direction so as to carry out scanning and exposing of the printing plate 12. Alternatively, a scanning and exposing device can be used in which a number of the light source units 100 are disposed in the sub-scanning direction at fixed intervals, the light source units 100 being moved integrally with one another in the subscanning direction to scan and expose by using a plurality of light beams.

A position adjusting mechanism 94 is provided at the platform 104, and through this position adjusting mechanism 94, the stage 106 is supported by the platform 104.

A pair of legs 106A and 106B is formed at the stage 106. The leg 106A is provided at the rotating drum 54 side (at the right side of FIG. 3), while the leg 106B is provided at the opposite side of the rotating drum 54. Each of the legs 106A and 106B and the platform 104 are connected by plate springs 108 by which the position adjusting mechanism 94 is formed. Each of the plate springs 108 is formed in a strip shape or a rectangular plate shape. Through a bracket 152, one end portion of each of the plate springs 108 is connected to each of the legs 106A and 106B, while, through a bracket 154, the other end portion is mounted to the platform 104.

At this time, both end portions of each of the plate springs 108 are respectively fixed to the brackets 152 and 154 by at least two screws 156. Accordingly, the stage 106 is supported by the plate springs 108 at the platform 104. Further, one of the surfaces of each of the plate springs 108 faces the rotating drum 54, and the plate spring 108 can thereby elastically deform in a direction in which the plate springs 108 approach/separate from the rotating drum 54 (which is simply referred to as a direction of arrow z hereinafter). The plate spring 108 is prevented from elastically deforming in the sub-scanning direction which is the axial direction of the rotating drum 54 (an obverse-to-reverse direction of the page of FIG. 3). Namely, the stage 106 is supported by the platform 104 through the plate springs 108, and the stage 106 is thereby movable merely by elastically deforming the plate springs 108 in the direction of the arrow z.

Figure 4:
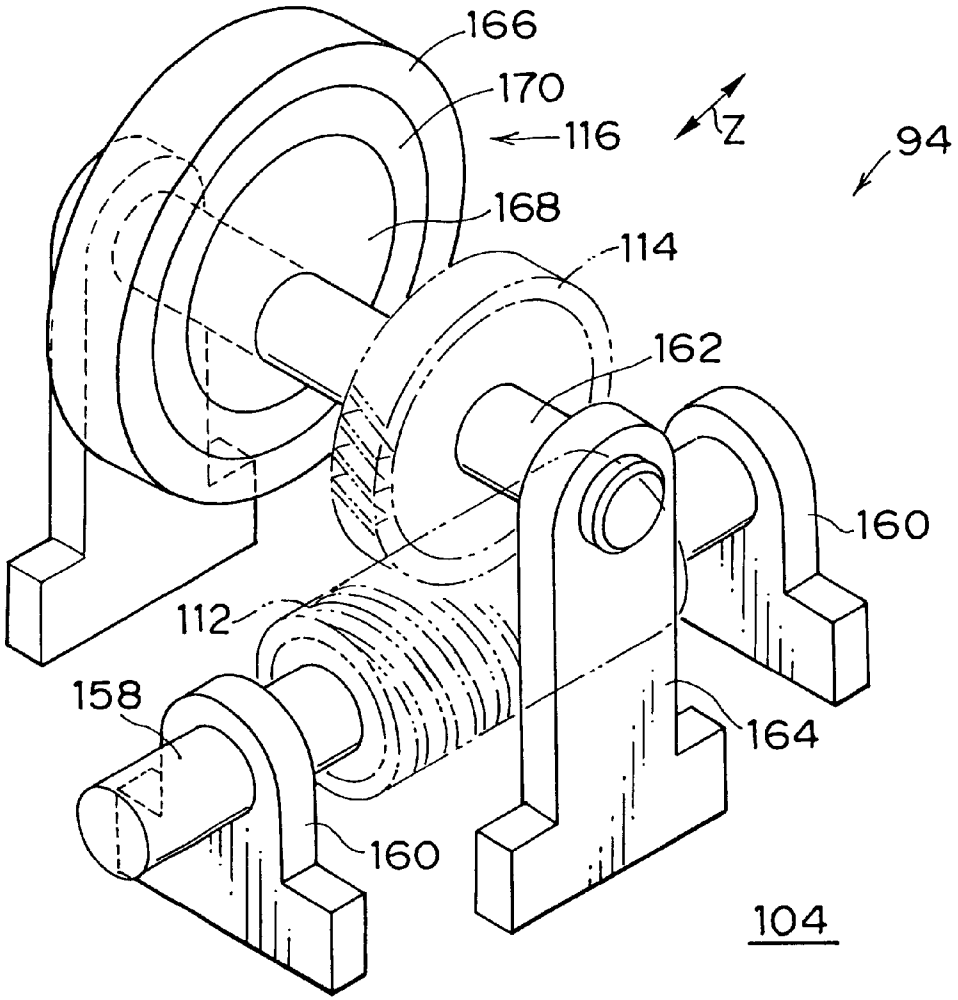
FIG. 4 is a schematic perspective view illustrating a main portion of a position adjustment mechanism provided at the scanning and exposing device.

A stepping motor 110 is provided at the platform 104, and a worm gear 112 is disposed beneath the stage 106. As shown in FIGS. 3 and 4, the worm gear 112 is attached to the shaft 158 whose axial direction is disposed along the aforementioned direction of the arrow z. Further, both sides of the shaft 158 between which the worm gear 112 is interposed is rotatably supported by a bracket 160.

As shown in FIG. 3, an axial direction end portion of the shaft 158 is connected to a driving shaft 110A of the stepping motor 110. Thus, when the stepping motor 110 is operated, the worm gear 112 thereby rotates.

Above the platform 104, a worm wheel 114 and an eccentric cam 116 are disposed between the pair of the legs 106A and 106B.

As shown in FIG. 4, the worm wheel 114 is attached to a shaft 162 and meshes with the worm gear 112. Accordingly, as the worm gear 112 rotates, the worm wheel 114 thereby rotates integrally with the shaft 162.

The shaft 162 is passed through brackets 164 which are mounted on the platform 104, and supported so as to rotate freely. Further, the shaft 162 is passed through the eccentric cam 116, and rotates integrally with the eccentric cam 116. The position of the eccentric cam 116 through which the shaft 162 is passed is displaced from the central axis of the eccentric cam 116. Thus, the eccentric cam 116 rotates eccentrically around the shaft 162 as a center.

Figure 5:
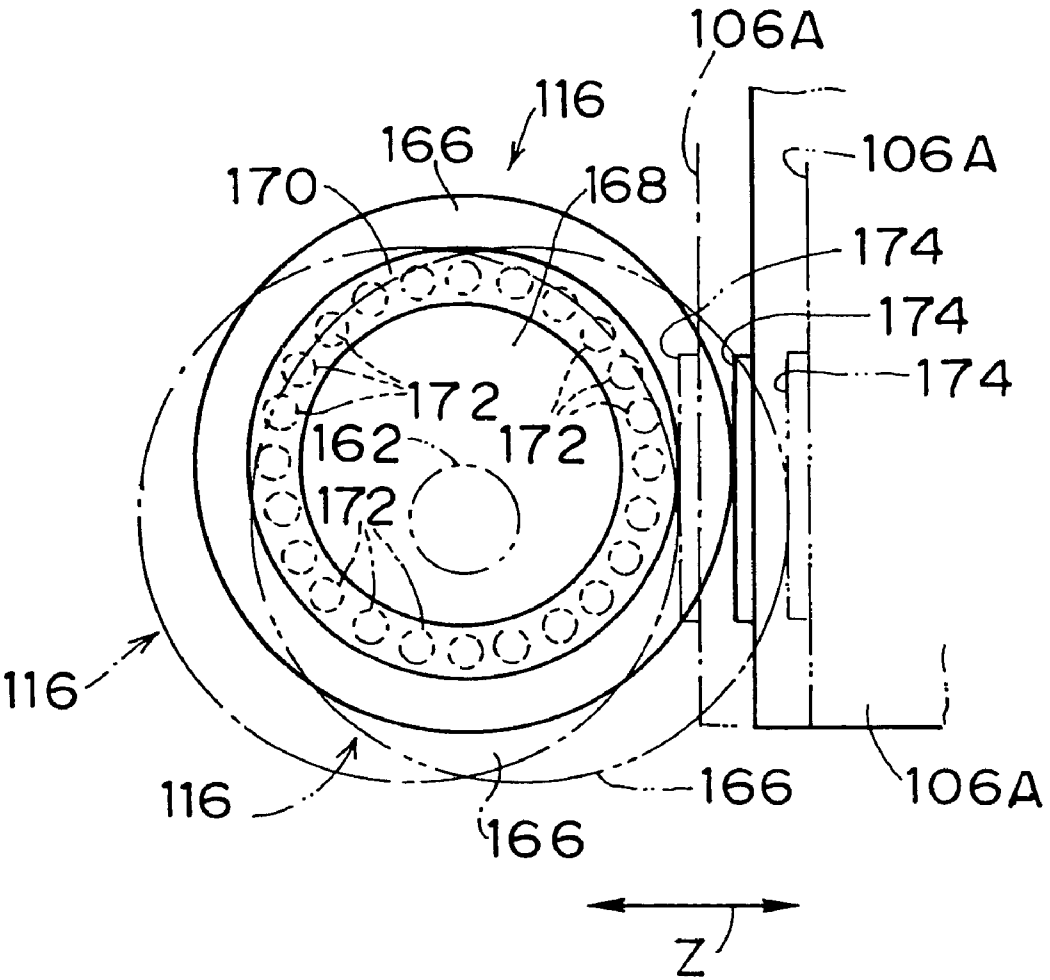
FIG. 5 is a schematic structural view illustrating a movement of a leg in accordance with a rotation of an eccentric cam.

As shown in FIGS. 4 and 5, at the eccentric cam 116, there is provided a bearing portion 170 between an outer circumference 166 and a central axis portion 168 through which the shaft 162 has been passed. As shown in FIG. 5, this bearing portion 170 is generally structured such that a number of spheres 172 are disposed at the inside thereof so as to rotate freely. This bearing portion 170 allows the outer circumference 166 and the central axis portion 168 of the eccentric cam 116 to rotate relative to one another.

As shown in FIGS. 3 and 5, the eccentric cam 116 is disposed so as to face the leg 106A of the stage 106. At the leg 106A, there is disposed a strip-shaped abutting plate 174 so as to face the outer circumferential surface of the eccentric cam 116.

The plate springs 118 are mounted to both the platform 104 and the stage 106 (the legs 106A and 106B) so as to urge the leg 106A toward the eccentric cam 116 in the direction in which the plate springs 118 separate from the rotating drum 54. Thus, the stage 106 is held in a state in which the abutting plate 174 which is provided at the leg 106A abuts the outer circumferential surface of the eccentric cam 116.

As shown in FIG. 5, the eccentric cam 116 eccentrically rotates around the shaft 162 as a center, and the outer circumference 166 thereby moves in the direction of the arrow z (the direction in which the plate springs 118 approach/separate from the rotating drum 54). At this time, the leg 106A is urged by the plate springs 108, and the leg 106A moves in accordance with the movement of the outer circumference 166 of the eccentric cam 116. Thus, the stage 106 moves in the direction of the arrow z.

As shown by a double-dashed line in FIG. 5, the outer circumference 166 of the eccentric cam 116 moves in the direction in which the plate springs 108 approach the rotating drum 54 (in the right direction of FIG. 5), and the leg 106A which abuts the outer circumference 166 of the eccentric cam 116 moves in resistance to the urging force of the plate springs 108. Further, as shown in a dashed-line in FIG. 5, since the outer circumference 166 of the eccentric cam 116 moves in the direction in which the plate springs 108 separate from the rotating drum 54 (in the left direction of the page of FIG. 5), the urging force of the plate springs 108 allows the leg 106A which abuts the outer circumference 166 of the eccentric cam 116 to move in accordance with the movement of the outer circumference 166. Accordingly, the stage 106 moves integrally with the leg 106A.

At the scanning and exposing device 90 which has the recording head 92 thus structured, the rotating drum 54 around which the printing plate 12 has been wound is made to rotate in the main scanning direction (the direction in which the printing plate 12 is attached and exposed), and synchronous with the rotation of the rotating drum 54 and the movement along the sub-scanning direction of the stage 106, on the basis of image data, a light beam is ejected from the light source assembly 124.

After the light beam which is emitted from the light source assembly 124 has been transmitted through the optical filter 152 which is the ½ wavelength plate, the light beam is transmitted through the convex cylindrical lens, the aperture, the parallel plate, the concave cylindrical lens, the uniaxial crystalline, the convex cylindrical lens, and the converging lens, and is then irradiated onto the printing plate 12 which has been wound around the rotating drum 54. As a result, on the basis of image data, an image is exposed onto the printing plate 12.

If a distance between the exposure head 92 and the printing plate 12 changes, the light beam which has been irradiated onto the printing plate 12 may be out-of-focus. In order to prevent this focal displacement, the distance between the exposure head 92 and the rotating drum 54 must be appropriately adjusted.

At the scanning and exposing device 90, there is disposed the position adjusting mechanism 94 between the stage 106 at which the exposure head 92 is provided, and the platform 104, and the stage 106 is moved in the direction of the arrow z, thereby allowing the distance between the exposure head 92 and the rotating drum 54 to be adjusted.

At this position adjustment mechanism 94, when the stepping motor 110 is driven to rotate the worm gear 112, this rotation is decelerated, and through the worm wheel 114, the decelerated rotation is transmitted to the shaft 162 onto which the eccentric cam 116 is fitted. When the shaft 162 rotates, the eccentric cam 116 thereby rotates eccentrically around the shaft 162 as a center, and the outer circumference 166 of the eccentric cam 116 moves in the direction of the arrow z.

The leg 106A which is moved to the stage 106 due to the urging force from the plate springs 108 abuts this eccentric cam 116. Thus, in accordance with the movement of the outer circumference 166, the stage 106, together with the leg 106A, moves in the direction of the arrow z.

A distance between the exposure head 92 which is provided at the stage 106 and the rotating drum 54 can be appropriately adjusted by controlling the amount in which the eccentric cam 116 rotates. At this time, since a rotation of the stepping motor 110 is largely decelerated by the worm gear 112 and the worm wheel 114, and is then transmitted to the eccentric cam 116, a fine adjustment of the amount in which the stage 106 moves can be greatly facilitated.

The plate springs 108 urge the leg 106A toward the outer circumference 166 of the eccentric cam 116. At a position to which the outer circumference 166 has rotated and moved, the leg 106A is held in a state of abutting this outer circumference 166. Namely, when the eccentric cam 116 is held in a state in which the eccentric cam 116 has stopped rotating, the stage 106 is held at a position at which the leg 106A abuts the outer circumference 166.

By using the eccentric cam 116, the stage 106 can be moved and reliably held at a desired position to which the stage 106 has moved. Accordingly, a complicated mechanism for holding the stage 106 at the desired position becomes unnecessary, and a mechanism for moving and holding the stage 106 can be structured more simply.

In a case in which the thickness of each of the plate springs 108 is about 1.6 mm, for example, the plate springs 108 can be formed so as to have a buckling load of 10 tons or more. Accordingly, as compared to a case in which the stage 106 is moved by using a rail-type moving mechanism, the plate springs 108 of the present invention exhibit a high load-resistance. Accordingly, the stage 106 can move in a stable manner when a high load is applied to the plate springs 108. Further, due to a selection of a thickness or a material of the plate springs 108, a reaction force (urging force) from the plate springs 108 can be changed, and the reaction force of the plate springs 108 can thereby be set on the basis of a load or the like. As a result, the stage 106 can be supported by the plate springs 108.

The bearing portion 170 of the eccentric cam 116 allows both the outer circumference 166 on which the abutting plate 174 at the leg 106A abuts and the central axis portion 168 which rotates integrally with the shaft 162 to rotate with one another.

When the central axis portion 168 of the eccentric cam 116 is made to rotate in order to move the stage 106 integrally with the leg 106A, as the outer circumference 166 rotates, the abutting plate 174 and the outer circumference 166 are rubbed against one another.

In a case in which the outer circumference 166 of the eccentric cam 116 and the abutting plate 174 are rubbed against one another, when abrasion or deformation is caused onto the outer circumference 166 and/or the abutting plate 174, the eccentric cam 116 does not rotate smoothly or the amount in which the leg 106A moves becomes unfixed, thus leading to an appropriate control of the moving amount of the stage 106.

At the eccentric cam 116, there is provided the bearing portion 170 between the outer circumference 166 and the central axis portion 168. Due to a frictional force between the outer circumference 166 and the abutting plate 174 which contacts the outer circumference 166, the outer circumference 166 and the central axis portion 168 rotate relative to one another.

As a result, the abutting plate 174 can be held at a substantially fixed position of the outer circumference 166 in a state in which the abutting plate 174 and the outer circumference 166 make contact with each other. Accordingly, abrasion or deformation can be prevented by the outer circumference 166 and the abutting plate 174 being rubbed against one another during the rotation of the eccentric cam 116. Therefore, since the stage 116 can move in accordance with the amount of the rotation of the eccentric cam 116, the amount in which the stage 106 moves due to the rotation of the eccentric cam 116 can accurately be controlled.

In the present embodiment, the plate-shaped abutting plate 174 abuts the circumferential surface of the outer circumference 166 which is formed by curved surfaces. However, for example, a flat surface can be formed at a portion of the outer circumference 166 and made to abut the abutting plate 174. Thus, a dimension in which the abutting plate 174 and the eccentric cam 116 contact each other is made larger, thereby enabling the abutting plate 174 to abut the outer circumference 166 of the eccentric cam 116 in a more stable manner. As a result, the stage 106 can be moved reliably and held at a position to which the stage 106 has moved.

In this way, at the scanning and exposing device 90, since the distance between the printing plate 12 and the exposure head 92 can be adjusted by the position adjustment mechanism 94 using the eccentric cam 116 so as to have an appropriate distance therebetween, and be held at a position where an adjustment of the distance has been carried out, a light beam is not out-of-focus when irradiated onto the printing plate 12 so that a highly accurate image can be formed on the printing plate 12.

The structure of the present invention is not limited to the present embodiment described above. For example, when the stage 106 is elongated along the axial direction of the rotating drum 54, and a plurality of the light source heads 100 are mounted on the stage 106, the position adjustment mechanism 94 can be provided at both sides of the stage 106 in the lengthwise direction thereof.

A description of the present embodiment has been made by using the plate springs 108 as an urging and holding means. However, instead of the plate springs 108, the urging and holding means can be formed by an urging means which urges the leg 106A toward the eccentric cam 116, a supporting means which supports the stage 106 movably by using a guide rail, and the like.

In the present embodiment, as an example of an image forming device, a description of the image forming device 10 for forming an image on the printing plate 12 has been made. However, the present invention is not limited to a light-sensitive planographic printing plate such as the printing plate 12. The present invention can be applied to image forming devices in which an image is formed not only on a light-sensitive planographic printing plate such as the printing plate 12 but on various recording mediums including a light-sensitive material such as a photographic film or printing paper, a light-sensitive drum, and the like.

In the present embodiment, the present invention has been applied for the purpose of moving and holding the exposure head 92. However, the present invention can also be used to mount such a component for forming an optical system, which includes an optical component such as a lens, a light source such as an LD, a component such as a CCD for which a short stroke positional adjustment is needed, and the like.

As described above, the present invention has a simple structure that uses the urging and supporting means which supports the legs of the stage in a state in which this means urges the legs toward the eccentric cam. By using the eccentric cam, the stage can be moved and held accurately at an arbitrary position to which the stage has moved. The present invention is also structured such that the bearing portion is provided at the eccentric cam, thereby allowing the central axis portion and the outer circumference to rotate relative to one another. As a result, excellent effects can be obtained in that abrasion or deformation of a component such as the eccentric cam can be prevented, the stage can move accurately for a long period of time, and the stage can be fixed at a position to which the stage has moved.

What is claimed is:

1. A base structure, the base structure comprising:

(A) two bases, one of which is operative to move linearly in relation to the other;

(B) at least one elastic member in connection with said bases which positions said bases away from each other and maintains a space between said bases;

(C) a cam element provided at one of said two bases and positioned in said space, said cam element driven to rotate; and (D) an abutting portion provided at the other of said two bases and on which said cam element abuts, (E) wherein said cam element includes:

a central axis portion rotatable around a rotational axis as a center;

a rolling element movably provided at said central axis portion; and a cylindrical outer ring rotatably provided with respect to said central axis portion through said rolling element, the rotational axes of said outer ring and said central axis portion being substantially parallel to one another and spaced apart from one another at a predetermined distance.

2. The base structure according to claim 1, wherein said rolling element includes a plurality of one of balls or rollers disposed so as to be rollable on the inner circumference of said outer ring.

3. The base structure according to claim 1, further comprising a driving source for driving and rotating said cam element, wherein a worm gear and a worm wheel are placed between said cam element and said driving source to transmit a driving force.

4. The base structure according to claim 1, wherein said bases are substantially connected relative to each other by a plurality of elastic members to enable relative movement thereof, and said elastic members generate a restoring force in accordance with the amount in which said bases have moved relative to one another during the relative movement.

5. The base structure according to claim 4, wherein due to said restoring force from said elastic members, a state in which said cam element abuts said abutting portion is maintained.

6. The base structure according to claim 4, wherein said elastic members comprise plate springs.

7. The base structure according to claim 1, wherein one of said bases is a platform disposed on the lower side and the other is a stage disposed on the upper side, said platform and said stage being substantially parallel to one another.

8. The base structure according to claim 7, wherein four corners of each of said platform and said stage are connected respectively to plate springs so that said platform and said stage can move relative to one another.

9. A processing device for applying a predetermined processing to an object, the processing device comprising:

(I) a processing element for applying a predetermined processing to an object; and (II) a base device capable of changing a position of said processing element with respect to said object, the base device including:

(a) a first base and a second base, one of said bases being operative to move linearly in relation to the other;

(b) at least one elastic member in connection with said bases which positions said bases away from each other and maintains a space between said bases;

(c) a cam element provided at said first base in said space and driven to rotate; and (d) an abutting portion provided at said second base and on which said cam element abuts, wherein said cam element includes:

a central axis portion rotatable around a rotational axis as a center;

a rolling element movably provided at said central axis portion; and a cylindrical outer ring rotatably provided with respect to said central axis portion through said rolling element, the rotational axes of said outer ring and said central axis portion being substantially parallel to one another and spaced apart from one another at a predetermined distance.

10. The device according to claim 9, wherein said rolling element includes a plurality of one of balls and rollers disposed so as to be rollable on the inner circumference of said outer ring.

11. The device according to claim 9, further comprising a driving source for driving and rotating said cam element, wherein a worm gear and a worm wheel are placed between said cam element and said driving source to transmit a driving force.

12. The device according to claim 9, wherein said bases are substantially connected relative to each other by a plurality of elastic members to enable a relative movement thereof, said elastic members generating a restoring force in accordance with the amount in which said bases have moved relative to one another during the relative movement, and said restoring force maintaining a state in which said cam element abuts said abutting portion.

13. The device according to claim 12, wherein said elastic members comprise plate springs.

14. The device according to claim 9, wherein said first base is a platform disposed on the lower side, and said second base is a stage disposed on the upper side, said platform and said stage are substantially parallel to one another, and four corners of each of said platform and said stage are connected respectively to plate springs so that said platform and said stage can move relative to one another.

15. An image forming device for forming an image on a printing plate, the image forming device comprising:

(I) a rotatably mounted drum having a periphery around which a printing plate can be releasably wound and fixed;

(II) a mount for rotatably supporting said drum;

(III) a recording head for recording an image on a printing plate;

(IV) a base device for changing a position of said recording head with respect to said rotating drum, said base device including:

(a) a first base and a second base, one of the bases being fixed at said mount side and the other being fixed at said recording head side- one of the bases being operative to move linearly in relation to the other;

(b) at least one elastic member in connection with said bases which positions said bases away from each other and maintains a space between said bases;

(c) a cam element provided at said first base in said space and driven to rotate; and (d) an abutting portion provided at said second base and on which said cam element abuts, (e) wherein said cam element includes:

a central axis portion rotatable around a rotational axis as a center;

a rolling element movably provided at said central axis portion; and a cylindrical outer ring rotatably provided with respect to said central axis portion through said rolling element, the rotational axes of said outer ring and said central axis portion being substantially parallel to one, another and spaced apart from one another at a predetermined distance.

16. The device according to claim 15, wherein said rolling element includes a plurality of one of balls and rollers disposed so as to be rollable on the inner circumference of said outer ring.

17. The device according to claim 15, further comprising a driving source for driving and rotating said cam element, wherein a worm gear and a worm wheel are placed between said cam element and said driving source to transmit a driving force.

18. The device according to claim 15, wherein said bases are substantially connected relative to each other by a plurality of elastic members to enable a relative movement thereof, said elastic members generating a restoring force in accordance with the amount in which said bases have moved relative to one another during the relative movement, and said restoring force maintaining a state in which said cam element abuts said abutting portion.

19. The device according to claim 18, wherein said elastic members comprise plate springs.

20. The device according to claim 15, wherein said first base is a platform fixed on the mount side, said second base is a stage on which said recording head is placed, said platform and said stage are substantially parallel to one another, and four corners of each of said platform and said stage are connected respectively to plate springs so that said platform and said stage can move relative to one another.

* * * * *